US008651477B2

(12) United States Patent
Chiba

(10) Patent No.: US 8,651,477 B2
(45) Date of Patent: Feb. 18, 2014

(54) SHEET FEEDING DEVICE AND IMAGE FORMING APPARATUS

(71) Applicant: Canon Kabushiki Kaisha, Tokyo (JP)

(72) Inventor: Yoshinao Chiba, Toride (JP)

(73) Assignee: Canon Kabushiki Kaisha

( * ) Notice: Subject to any disclaimer, the term of this patent is extended or adjusted under 35 U.S.C. 154(b) by 0 days.

(21) Appl. No.: 13/709,415

(22) Filed: Dec. 10, 2012

(65) Prior Publication Data

US 2013/0221607 A1 Aug. 29, 2013

(30) Foreign Application Priority Data

Feb. 23, 2012 (JP) ..... 2012-037542

(51) Int. Cl.
*B65H 1/18* (2006.01)

(52) U.S. Cl.
USPC ..... 271/152; 271/126; 271/127

(58) Field of Classification Search
USPC ..... 271/110, 126, 152, 153, 117, 127
See application file for complete search history.

(56) References Cited

U.S. PATENT DOCUMENTS

| | | | | |
|---|---|---|---|---|
| 5,927,703 | A * | 7/1999 | Endo | 271/10.03 |
| 7,240,899 | B2 * | 7/2007 | Amamoto | 271/126 |
| 7,457,580 | B2 * | 11/2008 | Kitamura | 399/393 |
| 8,322,705 | B2 * | 12/2012 | Oka et al. | 271/118 |
| 8,333,375 | B2 * | 12/2012 | Nishikata et al. | 271/127 |
| 8,398,072 | B2 * | 3/2013 | Ikeda | 271/117 |
| 8,459,635 | B2 * | 6/2013 | Inoue | 271/124 |
| 8,523,172 | B2 * | 9/2013 | Kawamura | 271/114 |
| 8,523,173 | B2 * | 9/2013 | Hayayumi | 271/117 |
| 2006/0237895 | A1 * | 10/2006 | Nishikata et al. | 271/121 |

FOREIGN PATENT DOCUMENTS

JP 2009-007086 A 1/2009

* cited by examiner

*Primary Examiner* — Kaitlin Joerger
(74) *Attorney, Agent, or Firm* — Fitzpatrick, Cella, Harper & Scinto

(57) ABSTRACT

A sheet supporting plate is vertically movably provided in a sheet feeding cassette, and a controller controls a lifting and lowering mechanism which lifts and lowers the sheet supporting plate based on basis weight information from an inputting portion. The controller stops the sheet supporting portion at a position where an abutting force causing a feeding roller biased by a feeding roller pressure spring to abut against a sheet is increased as the basis weight of the sheet is increased.

16 Claims, 10 Drawing Sheets

SHEET FEEDING DEVICE AND IMAGE FORMING APPARATUS

BACKGROUND OF THE INVENTION

1. Field of the Invention

The present invention relates to a sheet feeding device which feeds a sheet to an image forming portion, and an image forming apparatus including the sheet feeding device.

2. Description of the Related Art

Conventionally, an image forming apparatus, such as a printer or a copying machine, is provided with a sheet feeding device including a sheet feeding cassette being a sheet accommodating portion which accommodates a plurality of sheets, and a feeding portion which feeds the sheets accommodated in the sheet feeding cassette while separating the sheets one by one. As one example, the feeding portion of the sheet feeding device includes a feeding roller which feeds a sheet, and a separation roller which abuts against the feeding roller and separates a sheet. Also, as the sheet feeding cassette, a sheet stacking plate, on which sheets are stacked, is vertically movably provided. The sheet stacking plate is biased by a spring, and the sheet is pressed against the feeding roller. Thus, a feeding force is generated. In this configuration, the sheet feeding and the sheet separation are performed through the single feeding roller.

In such a sheet feeding device, when feeding a sheet, a top sheet stacked on the sheet stacking plate is discharged by rotating the feeding roller in a state where the feeding roller is pressed against the top sheet. Then, the discharged top sheet passes through a separation nip formed by the feeding roller and the separation roller which abuts against the feeding roller. In this manner, the sheet is separated one by one. Also, the sheet separated one by one is discharged to a conveying path which is directed toward an image forming portion (see Japanese Patent Laid-Open No. 2009-7086).

However, in the conventional sheet feeding device which performs the sheet feeding and the sheet separation through the single feeding roller, the sheet discharged by the feeding roller is conveyed while being bent after a sheet leading edge collides against a separation member such as the separation roller. In this case, a resistance force is applied to a sheet in a direction opposite to a conveying direction.

For this reason, when conveying the sheet, a conveying force greater than a resistance force generated by the collision of the leading edge of the sheet and the bending of the sheet needs to be applied to the sheet, but the resistance force differs according to a type of the conveyed sheet. Generally, since a sheet having a large basis weight has a high stiffness, the sheet receives a large resistance force. Therefore, as compared with a sheet having a small basis weight, it is necessary to apply a large conveying force. Therefore, when a sheet having a large basis weight is discharged, it is necessary to increase an abutting force between the sheet and the roller in order to apply a large conveying force.

However, in a case where the abutting force between the sheet and the roller is set to be large, a double feeding easily occurs so that multiple sheets are fed at a time when conveying a sheet having a small basis weight, that is, a sheet having a small resistance force.

Therefore, the present invention has been made in consideration of this phenomenon, and is directed to provide a sheet feeding device and an image forming apparatus, which can stably feed sheets having a different basis weight.

SUMMARY OF THE INVENTION

In the present invention, a sheet feeding device includes: a sheet stacking portion which is vertically movable and stacks a sheet thereon; a feeding roller which is vertically movably provided above the sheet stacking portion and feeds a sheet stacked on the sheet stacking portion; a roller biasing member which applies a force to the feeding roller to press the feeding roller against the sheet stacked on the sheet stacking portion; a lifting and lowering mechanism which lifts and lowers the sheet stacking portion; an inputting portion which inputs basis weight information of the sheet; and a controller which controls the lifting and lowering mechanism such that, when lifting the sheet stacking portion, based on the basis weight information from the inputting portion, the sheet stacking portion is stopped at a position where an abutting force causing the feeding roller to abut against the sheet is increased as the basis weight of the sheet is larger.

According to the present invention, when lifting the sheet stacking portion, based on the basis weight information, by stopping the sheet stacking portion at a position where an abutting force causing the feeding roller to abut against the sheet is increased as the basis weight of the sheet is larger, sheets having a different basis weight can be stably fed.

Further features of the present invention will become apparent from the following description of exemplary embodiments with reference to the attached drawings.

DESCRIPTION OF THE EMBODIMENTS

Figure 1:
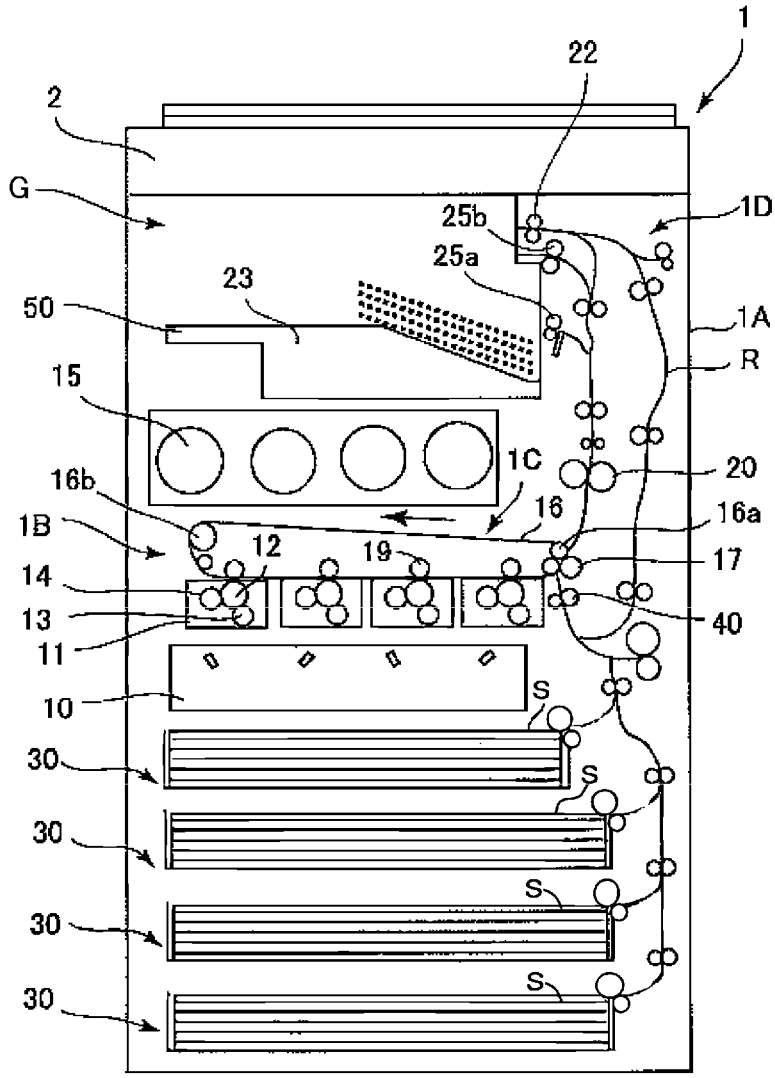
FIG. 1 is a diagram illustrating a schematic configuration of a full-color laser beam printer as one example of an image forming apparatus including a sheet feeding device according to a first embodiment of the present invention.

Hereinafter, a sheet feeding device according to an exemplary embodiment of the present invention will be described in detail with reference to the drawings. First, an overall configuration of an image forming apparatus including a sheet feeding device according to the present invention will be briefly described. FIG. 1 is a diagram illustrating a schematic configuration of a full-color laser beam printer as one example of an image forming apparatus including a sheet feeding device according to a first embodiment of the present invention.

In FIG. 1, a full-color laser beam printer (hereinafter, referred to as a printer) 1 includes a printer body 1A being a main body of the image forming apparatus, an image forming portion 1B which forms an image on a sheet, and a fixing portion 20. An image reading apparatus 2 is an upper apparatus which is substantially horizontally installed above the printer body 1A. A discharge space G for sheet discharge is formed between the image reading apparatus 2 and the printer body 1A. Also, the printer 1 includes a sheet feeding device 30 provided under the printer body 1A, and a toner cartridge 15.

After image information read by the image reading apparatus 2 or image information input from an external device such as a personal computer (not illustrated) is image-processed, the image information is converted into an electrical signal and is transmitted to a laser scanner 10 of the image forming portion 1B. In the image forming portion 1B, the surfaces of photosensitive drums 12 of respective process cartridges 11 are scanned by laser light corresponding to image information of yellow, magenta, cyan, and black component colors emitted from the laser scanner 10. Therefore, the surfaces of the photosensitive drums 12, which are uniformly charged with a predetermined polarity and potential by a charging device 13, are sequentially exposed, and the yellow, magenta, cyan, and black electrostatic latent images are sequentially formed on the photosensitive drums of the respective process cartridges 11.

Then, the electrostatic latent images are developed and visualized by the respective yellow, magenta, cyan, and black color toners, and respective color toner images on the respective photosensitive drums are sequentially superimposed and transferred on an intermediate transfer belt 16 by a primary transfer bias applied to a primary transfer roller 19. In this manner, the toner images are formed on the intermediate transfer belt 16.

On the other hand, a sheet S discharged from the sheet feeding device 30 passes through a pair of registration rollers 40 and is sent to a secondary transfer portion including a driving roller 16*a* and a secondary transfer roller 17. In the secondary transfer portion, the toner images formed in the image forming portion 1B are collectively transferred on the sheet S. Then, the sheet S, on which the toner images are transferred, is conveyed to a fixing portion 20. In the fixing portion 20, the sheet S is heated and pressurized so that the toner images are fixed on the sheet S as a color image. Then, the sheet S, on which the image is fixed, is discharged to the discharge space G by a pair of discharge rollers 25*a*, and is stacked on a stacking portion 23 protruding on the bottom of the discharge space G.

Also, when images are formed on two sides of the sheet S, after passing through the fixing portion 20, the sheet S is conveyed to a reversing roller 22 by a changeover of a changeover member (not illustrated). Due to a switchback by the reversing roller 22, the sheet S is conveyed to the pair of registration rollers 40 through a reconveying route R of a reconveying portion 1D. Then, by performing the same processing as the image formation on one side of the sheet S, the images are formed on two sides of the sheet S, and the sheet S is discharged to the discharge space G by the pair of discharge rollers 25*a*.

Figure 2:
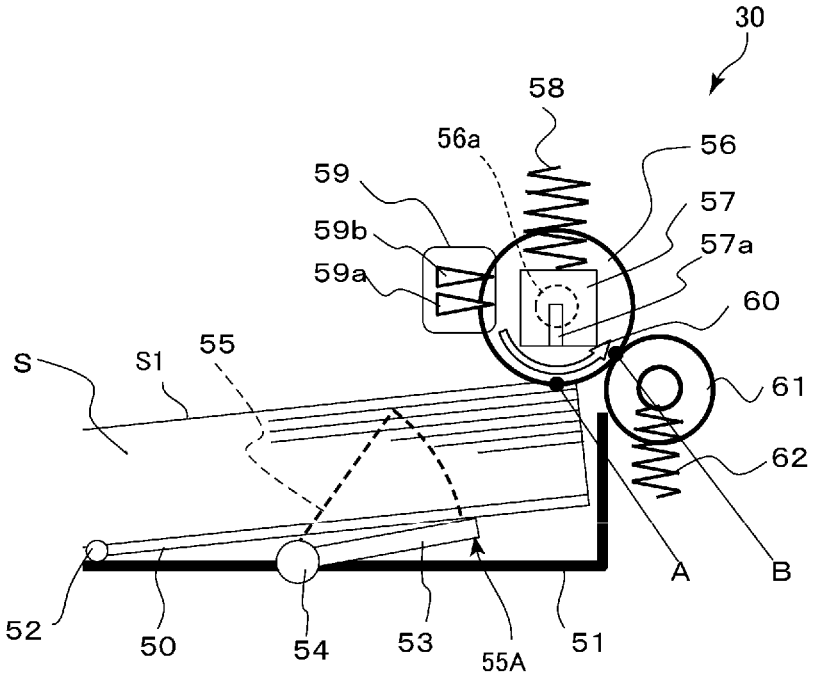
FIG. 2 is a diagram describing the configuration of the sheet feeding device.

FIG. 2 is a diagram illustrating the configuration of the sheet feeding device 30. The sheet feeding device 30 includes a sheet supporting plate 50 on which the sheet S is stacked. Also, the sheet feeding device 30 includes a sheet feeding cassette 51 being a sheet accommodating portion detachably mounted on the printer body 1A which also serves as the sheet feeding device body. The sheet supporting plate 50 is mounted to be vertically movable about a pivot point 52, that is, the sheet supporting plate 50 is mounted on a frame body of the sheet feeding cassette 51 such that a leading edge is vertically rotatable about the pivot point 52. Also, the sheet feeding device 30 includes a vertically movable feeding roller 56 which is provided above the sheet supporting plate 50 being the sheet stacking portion, abuts on a sheet feeding direction downstream side of the sheet S on the sheet supporting plate (sheet stacking portion), and conveys the sheet S.

Also, in FIG. 2, a separation roller 61 being a separation member is provided under the feeding roller 56, is contactably and separably pressed against the feeding roller 56 to form a separation nip B, and separates a sheet discharged by the feeding roller 56. The separation roller 61 and the feeding roller 56 constitute a separating portion which separately feeds a sheet one by one.

Figure 4:
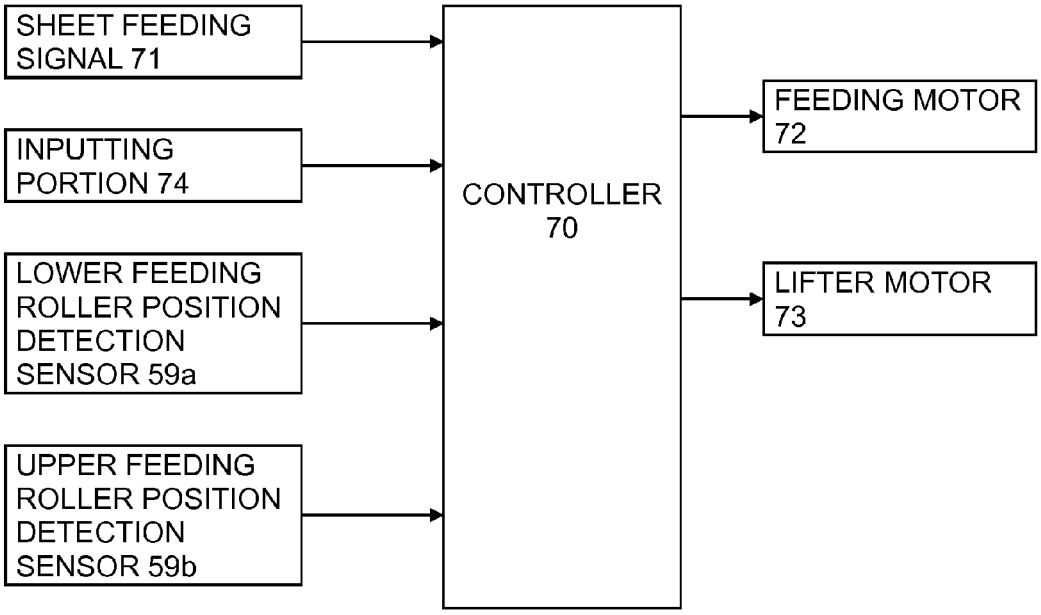
FIG. 4 is a control block diagram of the sheet feeding device.

A lifting and lowering mechanism 55A includes a lifter lever 55 which rotates about a shaft 54 serving as a pivot point by a lifter motor 73, which is illustrated in FIG. 4 and is to be described later. By the lifting and lowering mechanism 55A, the bottom surface of the sheet supporting plate 50 is supported by a lifter arm 53 which rotates in a vertical direction about the shaft 54 serving as the pivot point, and the sheet supporting plate 50 rotates in a vertical direction. Also, at the time of feeding the sheet, the lifter arm 53 is rotated upward to lift the sheet supporting plate 50. At the time of pulling out the sheet feeding cassette 51, the sheet supporting plate 50 is lowered by a self weight or a sheet load, integrally with the lifter arm 53, in conjunction with the operation of pulling out the sheet feeding cassette 51. In addition, when the sheet S is fed and thus the height of a top sheet S1 is lowered, the lifter motor 73 is driven to lift the sheet supporting plate 50 such that the height of the top sheet S1 becomes a feedable height abutting against the feeding roller 56 by a predetermined abutting pressure.

The feeding roller 56 is rotatably supported through a feeding roller shaft 56*a* by a feeding roller bearing 57. The feeding roller bearing 57 is vertically slidably supported by a guide (not illustrated) arranged along a vertical direction, and is biased in a substantially downward direction by a feeding roller pressure spring 58. That is, in the present embodiment, in a state where the feeding roller 56 is pressurized through the feeding roller bearing 57 in a substantially downward direction by the feeding roller pressure spring 58, the feeding roller 56 is linearly slidably supported in a vertical direction. Therefore, when the sheets are sequentially fed, as will be described later, the feeding roller 56 abuts against the sheet feeding direction downstream side of the sheet, and is gradually lowered integrally with the feeding roller bearing 57 biased by the feeding roller pressure spring 58.

The separation roller 61 is linearly slidably held with respect to the printer body 1A in a vertical direction by a separation guide (not illustrated), and the separation roller 61 abuts against the feeding roller 56 by a separation roller pressure spring 62 to form a separation nip B between the feeding roller 56 and the separation roller 61. The separation roller 61 has a built-in torque limiter (not illustrated). Therefore, when the feeding roller 56 is rotated, the separation roller 61 is driven to rotate. Also, when only one sheet S is discharged to the separation nip B, the separation roller 61 is driven to rotate as it is. However, when two or more sheets S are discharged, the separation roller 61 stops the driven rotation by the operation of the torque limiter. Since the separation roller 61 is stopped, only a sheet being in sliding contact with the feeding roller 56 is discharged, and the other sheets are stopped at the separation nip B by the separation roller 61.

Also, an elastic force of the feeding roller pressure spring 58 being a roller biasing member is set to be greater than an elastic force of the separation roller pressure spring 62 being a separation biasing member. Therefore, as will be described later, the sheets are sequentially fed. When the position of the top sheet S1 is lowered, the feeding roller 56 is lowered while integrally pushing down the separation roller 61.

Figure 3:
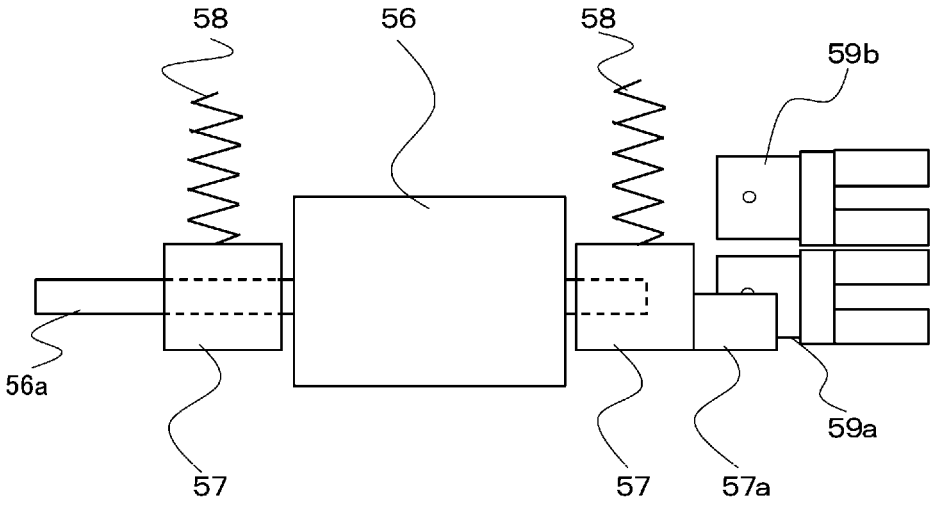
FIG. 3 is a diagram describing a position detection sensor of the feeding roller provided in the sheet feeding device.

By the way, a protrusion portion 57*a* being a sensor flag is provided in the feeding roller bearing 57. As illustrated in FIG. 3, lower and upper position detection sensors 59*a* and 59*b* of the feeding roller being a sensor portion which detects the protrusion portion 57*a* are provided in the printer body 1A. Also, in the present embodiment, the lower and upper position detection sensors 59*a* and 59*b* of the feeding roller and the protrusion portion 57*a* constitute a sheet surface detecting portion which detects the height of the top sheet stacked on the sheet supporting plate 50.

When the feeding roller 56 is lowered together with the feeding roller bearing 57 by a predetermined amount, the lower and upper position detection sensors 59*a* and 59*b* of the feeding roller detect the protrusion portion 57*a*. As illustrated in FIG. 4, detection signals of the lower and upper position detection sensors 59*a* and 59*b* of the feeding roller are input to a controller 70 which controls the sheet feeding operation of the sheet feeding device 30. Also, in addition to the lower and upper position detection sensors 59*a* and 59*b* of the feeding roller and the previously-described lifter motor 73, a feeding motor 72 which drives the feeding roller 56, and an inputting portion 74, such as a monitor of a personal computer or an image forming portion, which inputs the basis weight of the sheet, are connected to the controller 70. Also, a sheet feeding signal 71 which starts the sheet feeding operation is input from an external PC to the controller 70 (not illustrated).

The controller 70 controls ON/OFF of the respective motors, based on the sheet feeding signal 71 and the signals from the lower and upper position detection sensors 59*a* and 59*b* of the feeding roller which detect the height of the top sheet stacked on the sheet supporting plate 50. For example, when the detection signals are input from the lower and upper position detection sensors 59*a* and 59*b* of the feeding roller, the controller 70 drives the lifter motor 73 for a predetermined time. Therefore, the sheet supporting plate 50 is lifted, and the sheet S is pressed against the feeding roller 56 by the lifting of the sheet supporting plate 50. Then, when the sheet supporting plate 50 is further lifted, the feeding roller 56 is lifted against the feeding roller pressure spring 58. Therefore, a feedable pressure is applied to the sheet S.

Figure 5:
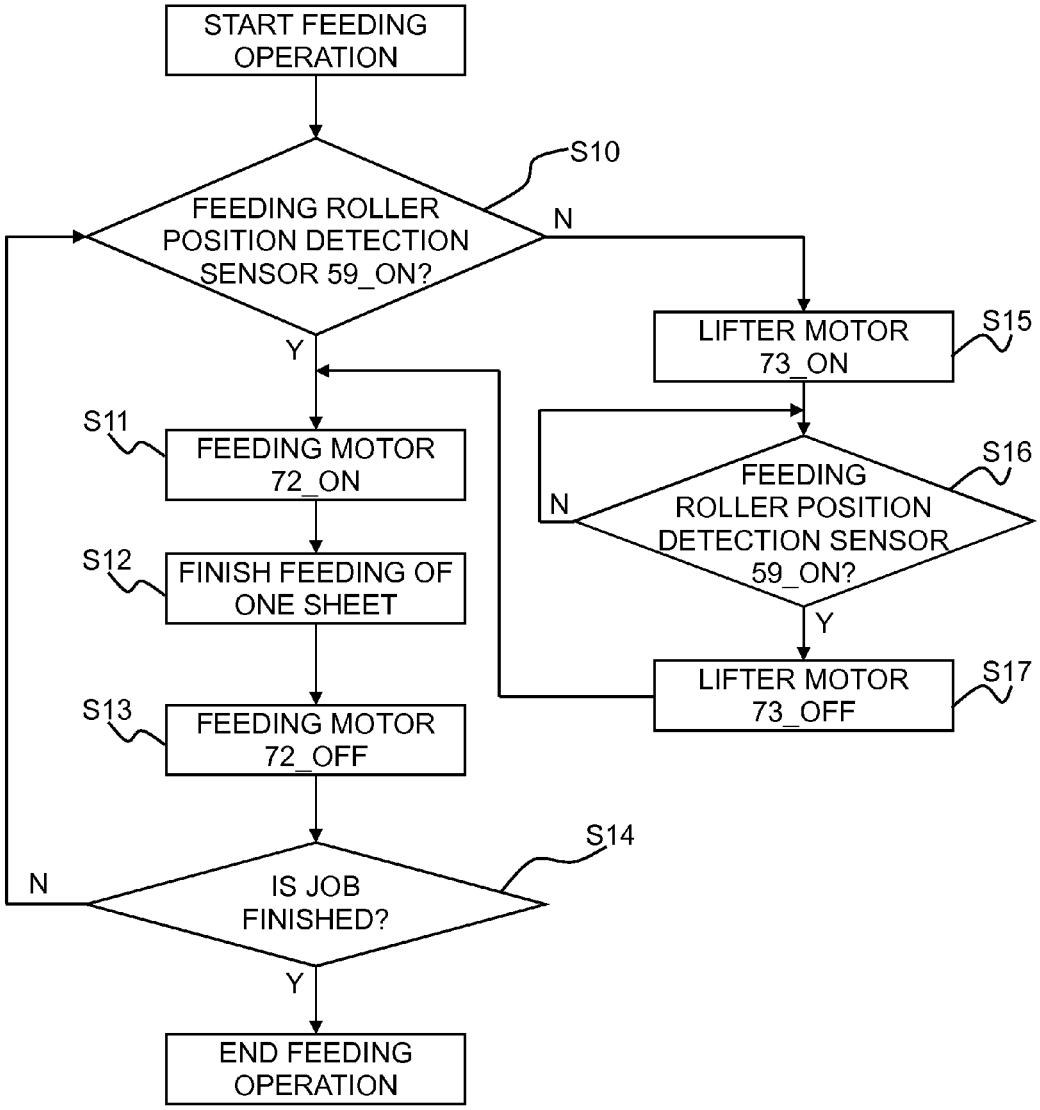
FIG. 5 is a flowchart describing a sheet feeding operation control of the sheet feeding device.

Next, the sheet feeding operation control of the sheet feeding device 30 having the above-described configuration after the sheet feeding cassette 51 is inserted into the printer body 1A will be described with reference to a flowchart illustrated in FIG. 5.

When the feeding operation is started, the controller 70 first drives the lifter motor 73 for a predetermined time, and determines whether or not the position detection sensors 59 (59*a*, 59*b*) of the feeding roller are ON (S10). That is, it is determined whether, after the sheet feeding cassette 51 is inserted, the sheet supporting plate 50 is lifted by a predetermined amount, and thus, the feeding roller 56 abuts against the sheet on the sheet supporting plate and moves to a feedable position. When the position detection sensor 59 of the feeding roller is ON (Y in S10), the feeding motor 72 is turned ON (S11). A driving force of the feeding motor 72 is transmitted to the feeding roller 56, and the feeding roller 56 is rotated in a direction of an arrow 60 illustrated in FIG. 2. By the rotation of the feeding roller 56, the sheet S is conveyed to the separation nip which is formed by the feeding roller 56 and the separation roller 61.

In this case, the separation roller 61 is driven to rotate by a torque of the feeding roller 56. When only one sheet S is discharged to the separation nip, the separation roller 61 is driven to rotate. However, when two or more sheets S are discharged, the rotation of the separation roller 61 is stopped by the operation of the torque limiter. Therefore, the sheet is separated in the separation nip one by one.

Then, the sheet separated one by one is conveyed toward the image forming portion, and the feeding of one sheet is completed (S12). Then, the feeding motor 72 is stopped (S13). Then, it is determined whether the job is finished (S14). When the job is not finished (N in S14), that is, when a next sheet is fed, the process returns to S10. Also, when the job is finished (Y in S14), the feeding operation is ended.

On the other hand, when the position detection sensor 59 of the feeding roller is not ON (N in S10), the controller 70 determines that the position of the top sheet is low, and starts (ON) the driving of the lifter motor 73 (S15). The driving force of the lifter motor 73 is transmitted to the lifter arm 53 through the lifter lever 55, and the lifter arm 53 is rotated upward. Therefore, the sheet supporting plate 50 is rotated upward.

Also, when the sheet supporting plate 50 starts the upward rotation, for example, when the sheet S does not abut against the feeding roller 56, the feeding roller 56 is pressurized in a substantially downward direction by the feeding roller pressure spring 58 as described above. Therefore, as illustrated in FIG. 2, the feeding roller pressure spring 58 is positioned at the lowest point of the slidably movable area. Therefore, when the sheet supporting plate 50 is rotated upward, the sheet abuts against the feeding roller 56. Then, the feeding roller 56 is lifted against the pressure of the feeding roller pressure spring 58.

Then, immediately when the feeding roller 56 is lifted, the position detection sensors 59 of the feeding roller detect the protrusion portion 57*a* and are turned ON (Y in S16). When a predetermined time has elapsed from the turn-ON of the position detection sensors 59 of the feeding roller, the controller 70 stops (OFF) the driving of the lifter motor 73 (S17). In this manner, the initial lift-up which moves the feeding roller 56 to the feedable position is completed. Also, when the initial lift-up is completed in this manner, the feeding roller 56 applies a feedable pressure to the sheet S by the feeding roller pressure spring 58. Subsequently, the feeding motor 72 is turned ON (S11), and the previously-described processing of S12 to S14 is repeated.

By performing the control in the above-described manner, the top surface position of the top sheet S1 is maintained at a substantially constant height, and the pressures of the feeding roller pressure spring 58 and the separation roller pressure spring 62 become substantially constant. Therefore, even when the stacking amount of sheets S is changed, the feeding roller 56 can continuously apply substantially the same conveying force as that set at the time of the initial lift-up to the top sheet.

By the way, when the sheet passes through the separation nip B, the leading edge of the sheet first collides against the separation nip B and then passes through the separation nip B while being bent. In this case, due to the collision of the leading edge and the bending, a resistance force occurs in the sheet. Therefore, the feeding force for feeding the sheet is required to be larger than the resistance force.

The magnitude of the resistance force differs according to a type (basis weight) of a sheet to be conveyed. Generally, since a sheet having a large basis weight has a high stiffness, the sheet receives a large resistance force. Therefore, as compared with a sheet having a small basis weight, it is necessary to apply a large conveying force. Therefore, when a sheet having a large basis weight is discharged, it is necessary to increase an abutting force between the sheet S and the feeding roller 56.

Therefore, in the present embodiment, as illustrated in FIG. 3 previously described, the lower and upper position detection sensors 59*a* and 59*b* of the feeding roller provided at positions having a different height are selected according to the basis weight. By controlling the stop of the lifter motor 73 using the selected position detection sensor 59 of the feeding roller, the abutting force between the sheet S and the feeding roller 56 is changed.

Figure 6A:
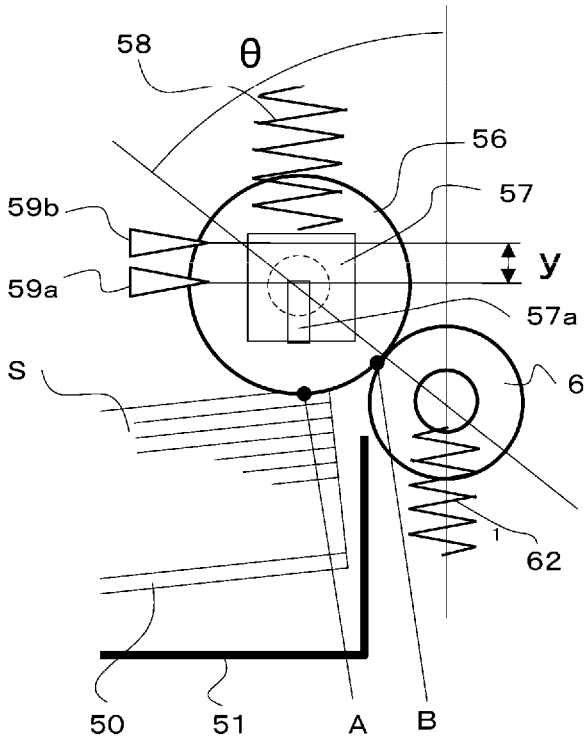
FIGS. 6A and 6B are diagrams describing a difference when the lift-up of the sheet feeding device is completed.
Figure 6B:
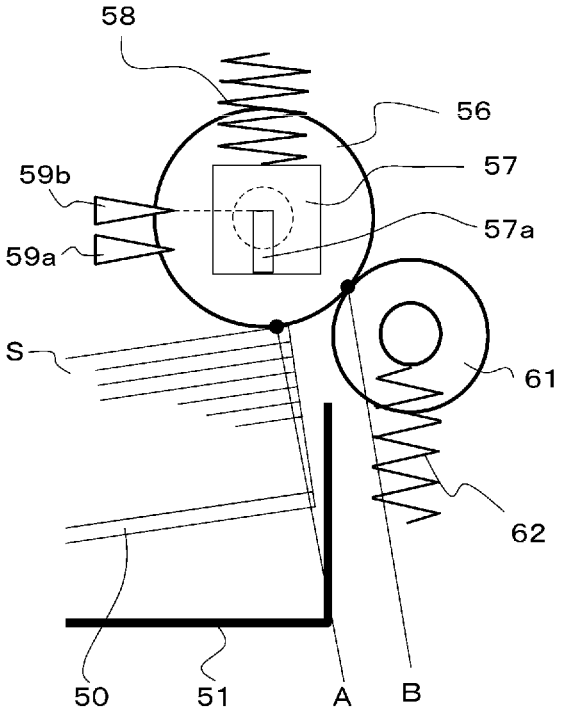

Next, the criteria and method for selecting the position detection sensor 59 of the feeding roller to be used will be described. In the sheet feeding device according to the present embodiment, assuming that a feeding pressure (pressing force of a point A) illustrated in FIGS. 6A and 6B is P and a separation pressure (pressing force of a point B) is N, P and N are expressed as Equations below.

$$P = FSD - FSC + WD + WC \tag{1}$$

$$\begin{aligned} N &= (FSC - WC + FT\sin\theta)/\cos\theta \\ &= (rFSC - rWC + T\sin\theta)/r\cos\theta \end{aligned} \tag{2}$$

Also, in Equations (1) and (2) above, FSD is a pressure of the feeding roller pressure spring 58, FSC is a pressure of the separation roller pressure spring 62, WD is a weight of the feeding roller, WC is a weight of the separation roller, and FT is a blocking force exhibited by the torque limiter on the circumference of the separation roller. Also, r is a radius of the separation roller, T is a torque value of the torque limiter, and θ is an abutting angle with respect to movable directions (lifting and lowering directions) of the feeding roller 56 and the separation roller 61, as illustrated in FIG. 6A.

A conveying force FF applied to the sheet S at the points A and B by the feeding roller is expressed as Equation (3) below. Also, in Equation (3), μ is a frictional coefficient between the feeding roller 56 and the sheet.

$$FF=\mu(P+N) \tag{3}$$

From Equation (3) above, it can be seen that as the total pressing force (P+N) of the feeding roller 56 with respect to the sheet increases, a larger conveying force is applied to the sheet. Herein, it will be considered a case that changes from a state where the top surface position of the sheet is changed by y in a vertically upward direction and the lower position detection sensor 59*a* of the feeding roller illustrated in FIG. 6A detects the protrusion portion 57*a*, to a state where the upper position detection sensor 59*b* of the feeding roller illustrated in FIG. 6B detects the protrusion portion 57*a*. In this case, a pressure FSD' of the feeding roller pressure spring 58 and a pressure FSC' of the separation roller pressure spring 62 are expressed as Equations below. Also, in Equations (4) and (5) below, KD is a spring constant of the feeding roller pressure spring 58, and KC is a spring constant of the separation roller pressure spring 62.

$$FSD'=FSD+KDy \tag{4}$$

$$FSC'=FSC-KCy \tag{5}$$

Both of the feeding roller 56 and the separation roller 61 are biased by the springs. Therefore, when the top surface height of the sheet, that is, the height of the feeding roller 56 and the separation roller 61 is changed, an amount of contraction of the feeding roller pressure spring 58 and the separation roller pressure spring 62 is changed. As a result, the total pressing force applied to the sheet is changed. A variation (ΔP+ΔN) of the total pressing force applied to the sheet in this case, which is obtained by substituting Equations (4) and (5) into Equations (1), (2) and (3), is expressed as Equation below.

$$\Delta P+\Delta N=y(KD-KC(1-\cos\theta)/\cos\theta) \tag{6}$$

Therefore, when KD, KC, and θ are set to satisfy Equation (7) below, the total pressing force applied to the sheet is increased as the lift-up stop position y becomes higher. Therefore, when KD, KC, and θ are set to satisfy Equation (7) below, the lift-up stop position has only to be set to be higher in order to increase the total pressing force applied to the sheet.

$$KD—KC(1-\cos\theta)/\cos\theta\geq 0 \tag{7}$$

On the contrary, when KD, KC, and θ are set to satisfy Equation (8) below, the total pressing force applied to the sheet is increased as the lift-up stop position y becomes lower. Therefore, when KD, KC, and θ are set to satisfy Equation (8) below, the lift-up stop position has only to be set to be low in order to increase the total pressing force applied to the sheet. For this purpose, the position of the upper position detection sensor 59*b* of the feeding roller has only to be lowered.

$$KD—KC(1-\cos\theta)/\cos\theta<0 \tag{8}$$

Figure 7:
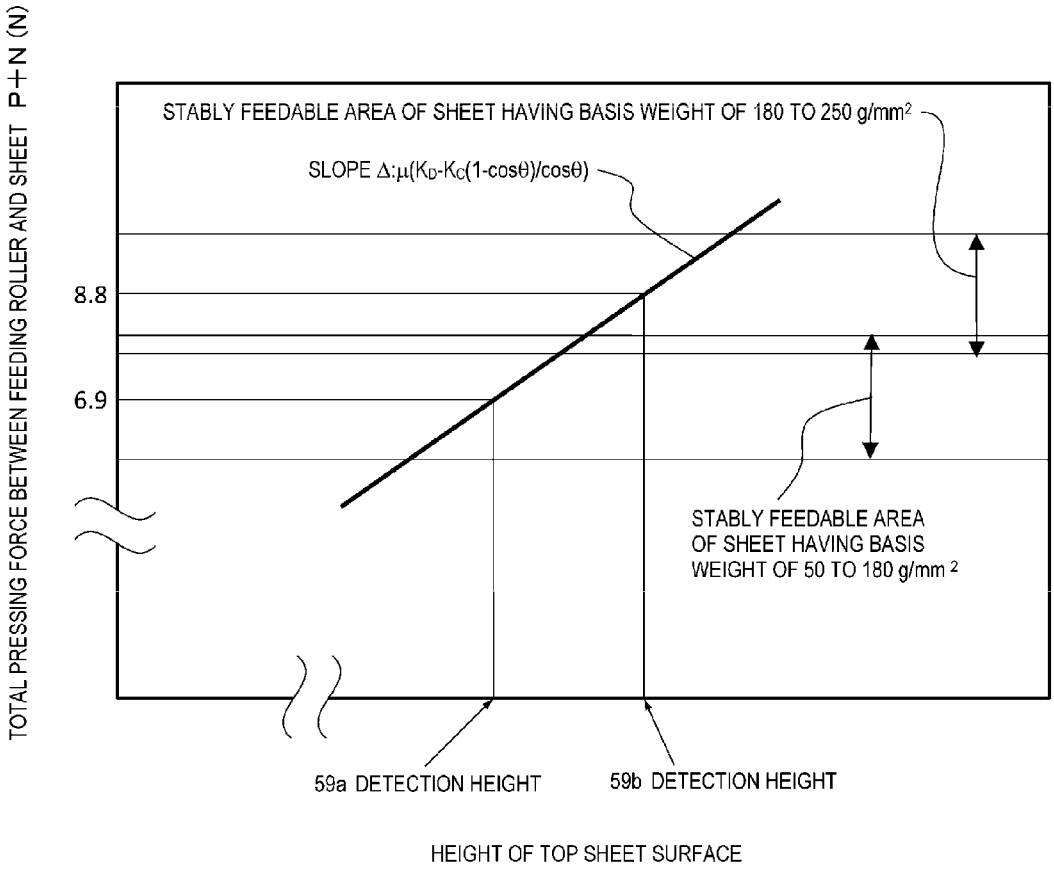
FIG. 7 is a diagram illustrating a relationship of a total pressing force between a feeding roller and a sheet, and a top surface height of a sheet in the sheet feeding device.

FIG. 7 is a graph illustrating a relationship between the total pressing force applied from the feeding roller 56 to the sheet, and the top surface height of the sheet at the time of the lift-up stop in the case where the configuration satisfies Equation (7) above. Generally, as the total pressing force of the feeding roller with respect to the sheet increases, a double feeding easily occurs so that multiple sheets are fed at a time. On the contrary, as the total pressing force decreases, a non-feeding easily occurs so that sheets cannot be conveyed. Therefore, there exists an appropriate total pressing force range for surely feeding and conveying the sheet one by one.

However, as illustrated in FIG. 7, the total pressing force applied for stably feeding the sheet without causing the double feeding or the non-feeding differs according to the basis weight of the sheet. In the present embodiment, the total pressing force of the sheet feeding device 30, which is suitable for stably feeding the sheet having a basis weight of 50 to 180 g/mm$^2$, is about 6.9 N. The total pressing force of the sheet feeding device 30, which is suitable for stably feeding the sheet having a basis weight of 180 to 250 g/mm$^2$, is about 8.8 N.

Furthermore, in FIG. 7, the total pressing force area capable of stably feeding the sheet, which is described as the stably feedable area, has a width of about 2.0 N to 2.5 N in both of the case where the basis weight of the sheet is less than 180 g/mm$^2$ and the case where the basis weight of the sheet is 180 g/mm$^2$ or more. Therefore, the total pressing force has to fall within a very narrow range so that the total pressing force applied to the sheet by the feeding roller 56 can cope with the sheet having a basis weight of 50 to 250 g/mm$^2$ by a constant configuration, without regard to the basis weight. It can be said that this is very difficult when considering the abrasion of the roller or the errors of parts.

Therefore, in the present embodiment, the lower and upper position detection sensors 59*a* and 59*b* of the feeding roller, as described above, are provided to select the sheet surface position according to the basis weight of the sheet S when the lifter motor 73 is stopped. Next, a description will be given of a method for controlling the driving of the lifter motor 73 such that the total pressing force between the feeding roller 56 and the sheet is changed according to the basis weight of the sheet.

First, a method for controlling the driving of the lifter motor 73 in the case where KD, KC, and θ are set to satisfy Equation (7) described above will be described. Also, basis weight information of the stacked sheet is input through the inputting portion 74 by a user prior to the start of the sheet feeding operation.

In this case, for example, when a sheet having a basis weight of less than 180 g/mm$^2$ is stacked, as illustrated in FIG. 6A, the protrusion portion 57*a* of the feeding roller bearing is detected by the lower position detection sensor 59*a* of the feeding roller, and the lifter motor 73 is stopped. Also, when a sheet having a basis weight of 180 g/mm$^2$ or more is stacked, the total pressing force applied to the sheet needs to be increased as previously described. Therefore, the lift-up stop position needs to be set to be high. Therefore, in this case, as illustrated in FIG. 6B, the protrusion portion 57*a* of the feeding roller bearing is detected by the upper position detection sensor 59*b* of the feeding roller, and the lifter motor 73 is stopped.

Next, a description will be given of a method for controlling the driving of the lifter motor 73 in the case where KD, KC, and θ are set to satisfy Equation (8) described above. In this case, for example, when a sheet having a basis weight of less than 180 g/mm$^2$ is stacked, as illustrated in FIG. 6B, the protrusion portion 57*a* of the feeding roller bearing is detected by the upper position detection sensor 59*b* of the feeding roller, and the lifter motor 73 is stopped. Also, when a sheet having a basis weight of 180 g/mm$^2$ or more is stacked, the total pressing force applied to the sheet needs to be increased as previously described. Therefore, the lift-up stop position needs to be set to be low. Therefore, in this case, as illustrated in FIG. 6A, the protrusion portion 57*a* of the feeding roller bearing is detected by the lower position detection sensor 59*a* of the feeding roller, and the lifter motor 73 is stopped.

By performing the control in the above-described manner, the top surface position of the sheet, that is, the stop position of the sheet supporting plate 50, can be changed according to the basis weight of the stacked sheet. Therefore, the total pressing force between the feeding roller 56 and the sheet can be set to a value suitable for the stable feeding.

Also, the relative positions of the lower and upper position detection sensors 59*a* and 59*b* of the feeding roller in height direction are obtained from a value of y, which is calculated by substituting the parameters (KD, KC, θ) determined by the configuration and the desired variation (ΔP+ΔN) of the total pressing force into Equation (6). Also, in the present embodiment, the variation (ΔP+ΔN) is 2.0 N.

Figure 8:
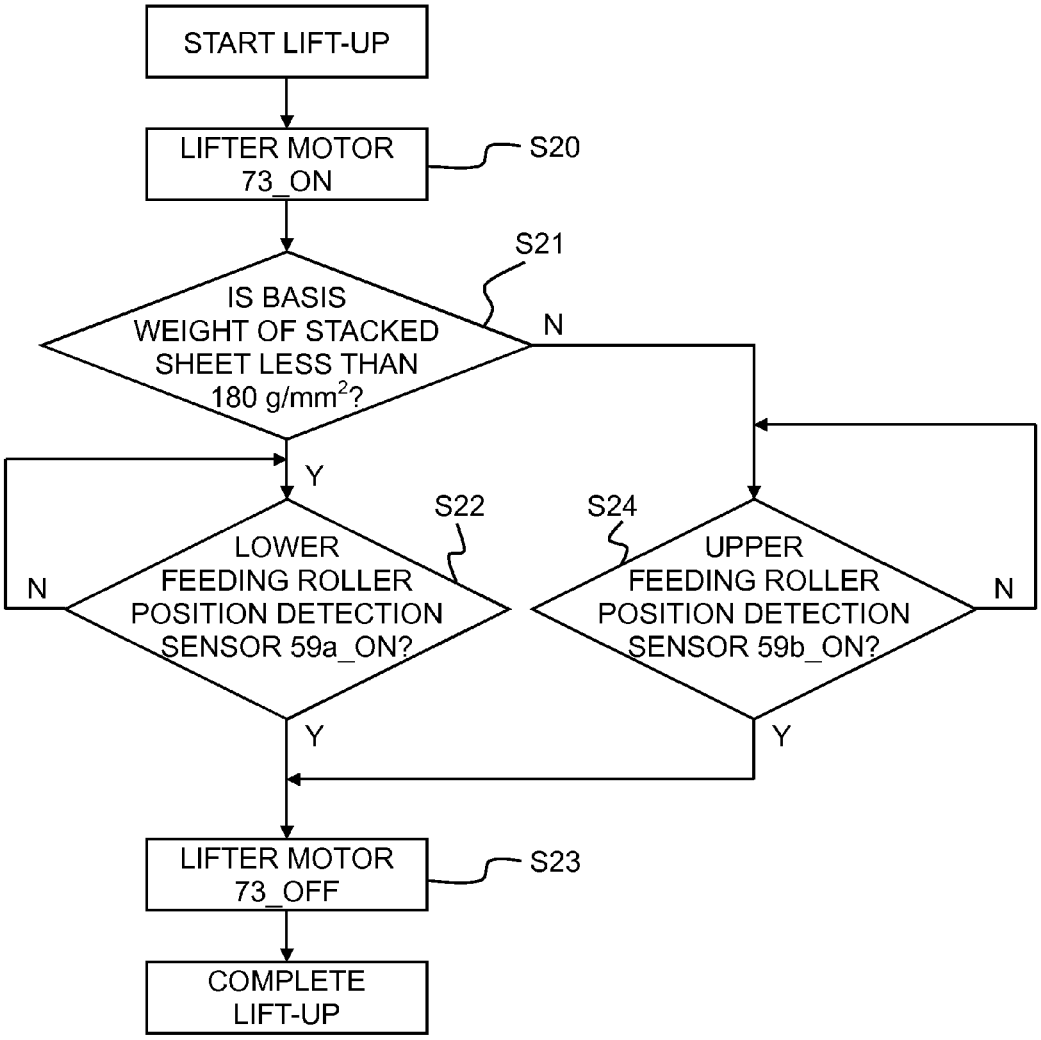
FIG. 8 is a flowchart describing a lift-up operation prior to a start of a sheet feeding operation of the sheet feeding device.

Next, the lift-up operation prior to the start of the sheet feeding operation in the case where KD, KC, and θ are set to satisfy the previously-described Equation (7) will be described with reference to a flowchart illustrated in FIG. 8. When the lift-up is started, the controller 70 first rotates the lifter motor 73 (S20) to lift the sheet supporting plate 50. Therefore, the sheet S on the sheet supporting plate 50 is lifted together with the sheet supporting plate 50 and abuts against the feeding roller 56. Then, the feeding roller 56 is lifted against the pressure of the feeding roller pressure spring 58.

Subsequently, the controller 70 determines whether or not the basis weight of the stacked sheet is less than 180 g/mm$^2$ (S21). When the basis weight of the stacked sheet is less than 180 g/mm$^2$ (Y in S21), the lower position detection sensor 59*a* of the feeding roller detects the protrusion portion 57*a* of the feeding roller bearing 57 and waits for being turned ON. When the lower position detection sensor 59*a* of the feeding roller is turned ON (Y in S22), the driving of the lifter motor 73 is stopped (OFF) after a predetermined time has elapsed (S23), and the lift-up operation is ended.

When the basis weight of the stacked sheet is 180 g/mm$^2$ or more (N in S21), the upper position detection sensor 59*b* of the feeding roller detects the protrusion portion 57*a* of the feeding roller bearing 57 and waits for being turned ON. When the upper position detection sensor 59*b* of the feeding roller is turned ON (Y in S24), the driving of the lifter motor 73 is stopped (OFF) after a predetermined time has elapsed (S23), and the lift-up operation is ended.

In the case where KD, KC, and θ are set to satisfy Equation (8) described above, when the basis weight of the stacked sheet is less than 180 g/mm$^2$ (Y in S21), the upper position detection sensor 59*b* of the feeding roller detects the protrusion portion 57*a* of the feeding roller bearing 57 and waits for being turned ON. When the upper position detection sensor 59*b* of the feeding roller is turned ON, the driving of the lifter motor 73 is stopped after a predetermined time has elapsed, and the lift-up operation is ended.

Also, when the basis weight of the stacked sheet is 180 g/mm$^2$ or more (N in S21), the lower position detection sensor 59*a* of the feeding roller detects the protrusion portion 57*a* of the feeding roller bearing 57 and waits for being turned ON. When the lower position detection sensor 59*a* of the feeding roller is turned ON, the driving of the lifter motor 73 is stopped (OFF) after a predetermined time has elapsed, and the lift-up operation is ended.

As described above, in the present embodiment, the lower and upper position detection sensors 59*a* and 59*b* of the feeding roller having different height positions are provided such that the position detection sensor 59 of the feeding roller to be used is selected according to the basis weight of the sheet S stacked on the sheet supporting plate 50. Therefore, a sheet having a wide-ranging basis weight can be stably conveyed by applying a large conveying force to a sheet having a large basis weight, as compared with a sheet having a small basis weight.

That is, when the sheet supporting plate 50 is lifted, the conveying force applied to the sheet can be changed according to the basis weight of the sheet by stopping the sheet supporting plate 50 at a position where the abutting force causing the feeding roller 56 to abut against the sheet increases as the basis weight of the sheet increases, based on information on the basis weight. Therefore, sheets having a different basis weight can be stably fed.

The case where the sheet surface position is controlled using two (multiple) position detection sensors of the feeding roller when the lifter motor 73 is stopped has been described so far, but the present invention is not limited thereto. For example, two protrusions may be provided in the feeding roller bearing 57, and the protrusions may be detected by a single position detection sensor of the feeding roller.

Figure 9:
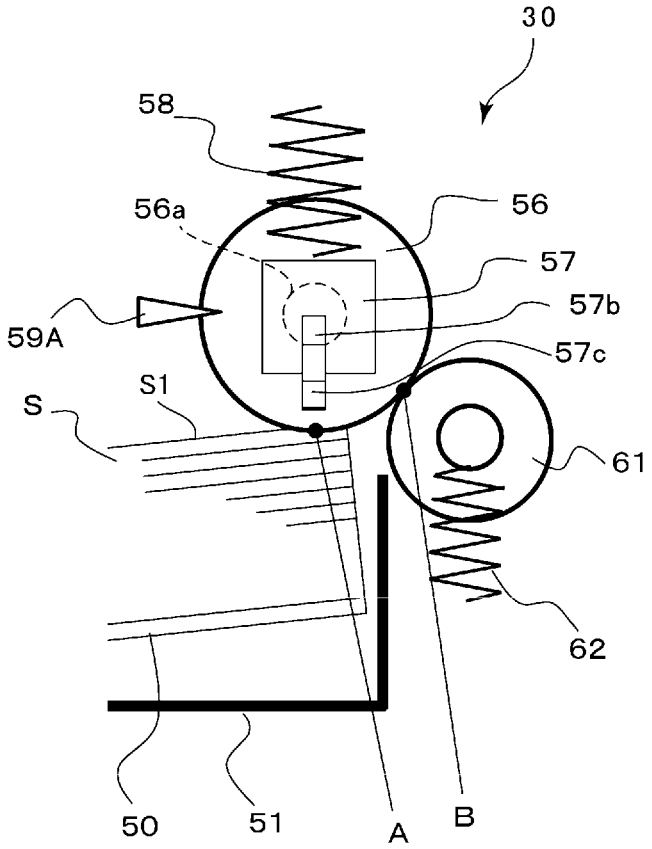
FIG. 9 is a diagram describing a configuration of a sheet feeding device according to a second embodiment of the present invention.

Next, a description will be given of a second embodiment of the present invention, in which two protrusions are provided in a feeding roller bearing 57, and the protrusions are detected by a single position detection sensor of the feeding roller. FIG. 9 is a diagram describing the configuration of the sheet feeding device according to the present invention. Also, in FIG. 9, the same reference numerals as those of FIG. 2 described above represent the same or equivalent portions.

In FIG. 9, an upper protrusion portion 57*b* is provided above the feeding roller bearing 57, and a lower protrusion portion 57*c* is provided under the feeding roller bearing 57. In the present embodiment, the upper and lower protrusion portions 57*b* and 57*c* are detected by the single position detection sensor 59A of the feeding roller.

Figure 10A:
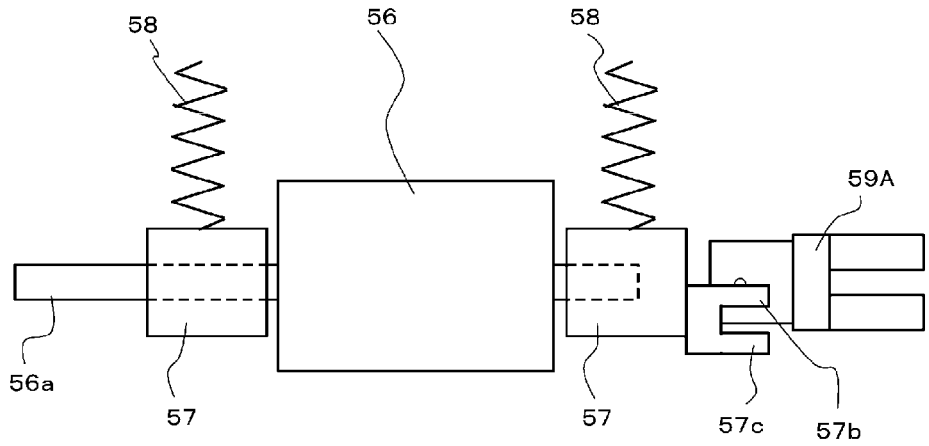
FIGS. 10A and 10B are diagrams describing a position detection sensor of the feeding roller provided in the sheet feeding device.

A description will be given of a case where the angle with respect to the movable directions of the feeding roller 56 and the separation roller 61, the spring constant of the feeding roller pressure spring 58, and the spring constant of the separation roller pressure spring 62 have already been set to have the relationship of Equation (7) described above. In this case, for example, when a sheet having a basis weight of less than 180 g/mm$^2$ is stacked, as illustrated in FIG. 10A, the position detection sensor 59A of the feeding roller detects the upper protrusion portion 57*b* of the feeding roller bearing 57, and the lifter motor 73 is stopped.

Figure 10B:
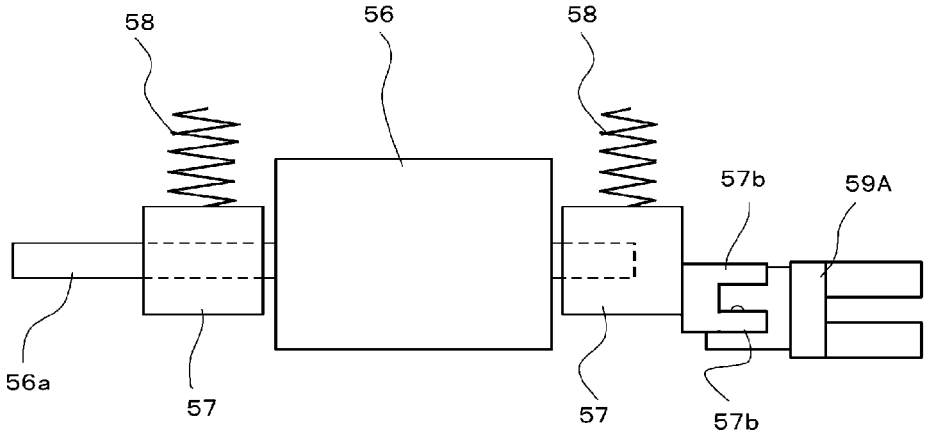

On the other hand, when a sheet having a basis weight of 180 g/mm$^2$ or more is stacked, as described above, the total pressing force applied to the sheet needs to be increased. Therefore, the lift-up stop position needs to be set to be high. Therefore, after the position detection sensor 59A of the feeding roller detects the upper protrusion portion 57*b*, as illustrated in FIG. 10B, the position detection sensor 59A of the feeding roller detects the lower protrusion portion 57*c*, and the lifter motor 73 is stopped. That is, when a sheet having a basis weight of 180 g/mm2 or more is stacked, the position detection sensor 59A of the feeding roller detects the protrusion portion two times so as to raise the lift-up stop position, and the lifter motor 73 is stopped.

Next, a description will be given of a case where the angle with respect to the movable directions of the feeding roller 56 and the separation roller 61, the spring constant of the feeding roller pressure spring 58, and the spring constant of the separation roller pressure spring 62 have already been set to have the relationship of Equation (8) described above. In this case, when a sheet having a basis weight of less than 180 g/mm$^2$ is stacked, the position detection sensor 59A of the feeding roller detects the upper protrusion portion 57*b* as illustrated in FIG. 10A, and the position detection sensor 59*a* of the feeding roller detects the lower protrusion portion 57*c* as illustrated in FIG. 10B. Then, the lifter motor 73 is stopped.

On the other hand, when a sheet having a basis weight of 180 g/mm$^2$ or more is stacked, the total pressing force applied to the sheet needs to be increased as previously described. Therefore, the lift-up stop position needs to be set to be high. Therefore, as illustrated in FIG. 10A, the position detection sensor 59A of the feeding roller detects the upper protrusion portion 57*b* of the feeding roller bearing 57, and the lifter motor 73 is stopped. That is, when a sheet having a basis weight of 180 g/mm$^2$ or more is stacked, the position detection sensor 59A of the feeding roller detects the protrusion portion one time, and the lifter motor 73 is stopped.

As described above, in the present embodiment, the sheet surface position when the lifter motor 73 is stopped can be controlled by the single position detection sensor 59A of the feeding roller. Therefore, the same effect as the first embodiment previously described can be obtained even by a slight shape modification, without providing a plurality of sensors.

In the first and second embodiments described so far, the sensor which generates the ON or OFF signal is used as the position detection sensor of the feeding roller, but the present invention is not limited thereto. For example, a sensor which can output a continuous value such as a volume detection may be used. When such a sensor is used, the top surface position of the sheet can be controlled more finely. Therefore, the sheet feeding performance is improved. Also, the top surface position of the sheet may be changed by changing the position of the position detection sensor of the feeding roller according to the basis weight set by the user.

Also, detecting the position itself of the feeding roller is not essential. The top surface position of the sheet may be detected by other detecting member, and the lifter motor may be controlled. By such a configuration, the position of the feeding roller is changed, and the total pressing force applied to the sheet by the feeding roller is changed. Furthermore, in the first and second embodiments previously described, the separation roller with the built-in torque limiter is described, but a pad having a high frictional force may be used instead of the separation roller.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-037542, filed Feb. 23, 2012, which is hereby incorporated by reference herein in its entirety.

What is claimed is:

1. A sheet feeding device comprising:

a sheet stacking portion which is vertically movable and stacks a sheet thereon;

a feeding roller which is vertically movably provided above the sheet stacking portion, and feeds a sheet stacked on the sheet stacking portion;

a roller biasing member which applies a force to the feeding roller to press the feeding roller against the sheet stacked on the sheet stacking portion;

a lifting and lowering mechanism which lifts and lowers the sheet stacking portion;

an inputting portion which inputs basis weight information of the sheet; and a controller which controls the lifting and lowering mechanism based on the basis weight information from the inputting portion such that, when lifting the sheet stacking portion, the sheet stacking portion is stopped at a position where an abutting force causing the feeding roller to abut against the sheet is increased as the basis weight of the sheet is larger.

2. The sheet feeding device according to claim 1, further comprising:

a separation member which is vertically movably provided under the feeding roller and which is pressed against the feeding roller to separate a sheet discharged by the feeding roller; and a separation biasing member which presses the separation member against the feeding roller, and applies a force level to the separation member to allow the separation member to be lowered integrally with the feeding roller when the feeding roller is lowered.

3. The sheet feeding device according to claim 2, wherein the roller biasing member and the separation biasing member include springs, and assuming that a spring constant of the spring of the roller biasing member is KD, a spring constant of the spring of the separation biasing member is KC, and an abutting angle with respect to lifting and lowering directions of the feeding roller and the separation member is θ, when the KD, the KC, and the θ are set to satisfy an equation of $KD-KC(1-\cos\theta)/\cos\theta \geq 0$ such that a pressing force causing the feeding roller to abut against the sheet is increased as a stop position of the sheet stacking portion becomes higher, the controller controls the lifting and lowering mechanism such that a stop position of the sheet stacking portion when a sheet having a large basis weight is stacked is higher than a stop position of the sheet stacking portion when a sheet having a small basis weight is stacked.

4. The sheet feeding device according to claim 2, wherein the roller biasing member and the separation biasing member include springs, and assuming that a spring constant of the spring of the roller biasing member is KD, a spring constant of the spring of the separation biasing member is KC, and an abutting angle with respect to lifting and lowering directions of the feeding roller and the separation member is θ, when the KD, the KC, and the θ are set to satisfy an equation of $KD-KC(1-\cos\theta)/\cos\theta<0$ such that a pressing force causing the feeding roller to abut against the sheet is increased as a stop position of the sheet stacking portion becomes lower, the controller controls the lifting and lowering mechanism such that a stop position of the sheet stacking portion when a sheet having a large basis weight is stacked is lower than a stop position of the sheet stacking portion when a sheet having a small basis weight is stacked.

5. The sheet feeding device according to claim 1, further comprising a sheet surface detecting portion which detects that a top sheet stacked on the sheet stacking portion has reached a height at which the feeding roller abuts with a predetermined abutting force according to a basis weight of a sheet, wherein the controller controls the lifting and lowering mechanism such that the sheet stacking portion is stopped based on a detection signal from the sheet surface detecting portion.

6. The sheet feeding device according to claim 5, wherein the sheet surface detecting portion comprises a sensor portion and a sensor flag, and the sensor flag is moved integrally with the feeding roller.

7. The sheet feeding device according to claim 6, wherein the sensor portion is provided in plurality at different heights.

8. The sheet feeding device according to claim 6, wherein the sensor flag has a plurality, and the plurality of sensor flags is detected by the single sensor portion.

9. An image forming apparatus comprising:

an image forming portion which forms an image on a sheet fed from a sheet feeding device, wherein the sheet feeding device comprises:

a sheet stacking portion which is vertically movable and stacks a sheet thereon;

a feeding roller which is vertically movably provided above the sheet stacking portion, and feeds a sheet stacked on the sheet stacking portion;

a roller biasing member which applies a force to the feeding roller to press the feeding roller against the sheet stacked on the sheet stacking portion;

a lifting and lowering mechanism which lifts and lowers the sheet stacking portion;

an inputting portion which inputs basis weight information of the sheet; and a controller which controls the lifting and lowering mechanism based on the basis weight information from the inputting portion such that, when lifting the sheet stacking portion, the sheet stacking portion is stopped at a position where an abutting force causing the feeding roller to abut against the sheet is increased as the basis weight of the sheet is larger.

10. The image forming apparatus according to claim 9, further comprising:

a separation member which is vertically movably provided under the feeding roller and which is pressed against the feeding roller to separate a sheet discharged by the feeding roller; and a separation biasing member which presses the separation member against the feeding roller, and applies a force to the separation member such that the separation member is lowered integrally with the feeding roller when the feeding roller is lowered.

11. The image forming apparatus according to claim 10, wherein the roller biasing member and the separation biasing member include springs, and assuming that a spring constant of the spring of the roller biasing member is KD, a spring constant of the spring of the separation biasing member is KC, and an abutting angle with respect to lifting and lowering directions of the feeding roller and the separation member is θ, when the KD, the KC, and the θ are set to satisfy an equation of $KD-KC(1-\cos\theta)/\cos\theta\geq 0$ such that a pressing force causing the feeding roller to abut against the sheet is increased as a stop position of the sheet stacking portion becomes higher, the controller controls the lifting and lowering mechanism such that a stop position of the sheet stacking portion when a sheet having a large basis weight is stacked is higher than a stop position of the sheet stacking portion when a sheet having a small basis weight is stacked.

12. The image forming apparatus according to claim 10, wherein the roller biasing member and the separation biasing member include springs, and assuming that a spring constant of the spring of the roller biasing member is KD, a spring constant of the spring of the separation biasing member is KC, and an abutting angle with respect to lifting and lowering directions of the feeding roller and the separation member is θ, when the KD, the KC, and the θ are set to satisfy an equation of $KD-KC(1-\cos\theta)/\cos\theta<0$ such that a pressing force causing the feeding roller to abut against the sheet is increased as a stop position of the sheet stacking portion becomes lower, the controller controls the lifting and lowering mechanism such that a stop position of the sheet stacking portion when a sheet having a large basis weight is stacked is lower than a stop position of the sheet stacking portion when a sheet having a small basis weight is stacked.

13. The image forming apparatus according to claim 9, further comprising a sheet surface detecting portion which detects that a top sheet stacked on the sheet stacking portion has reached a height at which the feeding roller abuts with a predetermined abutting force according to a basis weight of a sheet, wherein the controller controls the lifting and lowering mechanism such that the sheet stacking portion is stopped based on a detection signal from the sheet surface detecting portion.

14. The image forming apparatus according to claim 13, wherein the sheet surface detecting portion comprises a sensor portion and a sensor flag, and the sensor flag is moved integrally with the feeding roller.

15. The image forming apparatus according to claim 14, wherein the sensor portion has a plurality at different heights.

16. The image forming apparatus according to claim 14, wherein the sensor flag is provided in plurality, and the plurality of sensor flags is detected by the single sensor portion.

* * * * *